United States Patent [19]

Schetl

[11] Patent Number: 4,877,290

[45] Date of Patent: Oct. 31, 1989

[54] ROCKER MECHANISM WITH A LOCKING FACILITY

[75] Inventor: Laszlo Schetl, Jönköping, Sweden

[73] Assignee: Swing-Matic AB, Jonkoping, Sweden

[21] Appl. No.: 250,625

[22] PCT Filed: Feb. 17, 1987

[86] PCT No.: PCT/SE87/00079

§ 371 Date: Sep. 20, 1988

§ 102(e) Date: Sep. 20, 1988

[87] PCT Pub. No.: WO87/04908

PCT Pub. Date: Aug. 27, 1987

[30] Foreign Application Priority Data

Feb. 19, 1986 [SE] Sweden ..... 8600764-8

[51] Int. Cl.[4] ..... A47C 3/02; A47C 3/00

[52] U.S. Cl. ..... 297/270; 297/302

[58] Field of Search ..... 297/302, 301, 303, 313, 297/270, 269

[56] References Cited

U.S. PATENT DOCUMENTS

| | | | |
|---|---|---|---|
| 2,698,649 | 1/1955 | Hopkes | 297/269 |
| 2,907,373 | 10/1959 | Katz | 297/269 |
| 3,101,971 | 8/1963 | Hampton | 297/259 |
| 4,099,775 | 7/1978 | Mizelle | 297/303 |
| 4,198,094 | 4/1980 | Bjerknes et al. | 297/306 |
| 4,438,898 | 3/1984 | Knoblauch et al. | 297/304 |
| 4,664,445 | 5/1987 | Groseth | 297/270 |

FOREIGN PATENT DOCUMENTS

| | | |
|---|---|---|
| 916263 | 8/1954 | Fed. Rep. of Germany . |
| 125568 | 10/1972 | Norway . |

*Primary Examiner*—James T. McCall

*Attorney, Agent, or Firm*—Dann, Dorfman, Herrell & Skillman

[57] ABSTRACT

A rocker mechanism (10) preferably intended for rotatable arm chairs, comprising an upper part (12) which is attached to a seat and which is pivotally journalled to an underpart (14) by means of a horizontal pivot shaft (24), the underpart being carried by the vertical supporting pin of, for example, a rotatable arm chair. The underpart presents an upstanding holder (36) having a throughpassing opening (38) for accommodating a locking rod (48) provided with a handle and extending parallel with the pivot shaft (24), and promontories (40) which have a trapezium-shape cross section and which are intended for abutment with recesses (41) in two clamping plates or jaws (76) located on a respective side of the holder. The locking rod (48) is journalled in bearing blocks (58) on the upper part (12) and presents a lefthand screwthread (50) and a righthand screwthread (52) which co-act with respective screwthreaded holes (51 and 53) provided in the clamping plates or jaws (76). The promontories (40) of the holder and the corresponding recesses (41) of the clamping plates present curved surfaces (44, 46 and 45, 47) the center of curvature of which is located in the pivot center of the pivot shaft (24).

12 Claims, 4 Drawing Sheets

ROCKER MECHANISM WITH A LOCKING FACILITY

The present invention relates to a rocker mechanism for chairs and the like which incorporates a locking facility to anchor the seat in different tilt positions relative to the underpart.

It has become very popular in recent times to equip seating furniture, and in particular revolvable armchairs, with some form of rocker mechanism. Such rocker mechanisms enable one to sit in the armchair and rock back and forth, or to tilt the armchair, by shifting one's weight, and to remain seated in the chair with the chair thus inclined. The drawback with such mechanisms, however, is that the chair will not remain in the tilted or inclined position to which it has been adjusted, but will move to a new position as soon as the weight of the body is shifted.

To overcome this drawback there is proposed in Norwegian Patent No. 125568 a rocker mechanism locking facility which comprises an arm which projects out from the underpart of the mechanism and which carries a vertical, planar locking plate. The plate is embraced by two clamping jaws which are manipulated with the aid of a locking bar or rod provided with a righthand and a lefthand screwthread.

This known arrangement is encumbered with a number of drawbacks. For example, clamping jaws, or plates, which abut a flat counter-pressure plate do not lock the mechanism reliably. If an attempt is made to overcome this, by tightening the clamping plates still harder, the screwthreads and the locking rod bearings are liable to become worn, and the locking arrangement may even be broken as a result of excessive tightening of the plates. Furthermore, because no hole is provided in the plate for throughpassage of the locking rod, there is obtained a complicated construction when the load applied thereto is uneven, which further increases the risk of wear and poor locking qualities. In addition, because the plate is located on an arm which projects laterally outwards from the underpart of the rocker mechanism, the arm is subjected to vertically acting torque, which leads to high stress concentrations and the risk of fatigue fractures at the point at which the arm is attached to said underpart. Because the clamping jaw attachments are not centred exactly in relation to the plate, the arm may also be subjected to laterally acting forces.

U.S. Pat. No. 3,101,971 proposes a locking arrangement for rocker mechanisms having a holder arm which is pivotally mounted on the underpart of the mechanism and which presents an elongated opening for accommodating the shaft or axle of the locking arrangement. The shaft presents a nut which is held by a lock-nut and which forms a fixed abutment for a washer or plate which acts against the holder arm. The shaft extends through the elongated opening and a hole in the upperpart of the rocker mechanism and is screwed into a non-rotatably positioned nut. When tightening the shaft the holder arm is held clamped between the aforesaid plate and the side of said upperpart.

This arrangement also incorporates flat abutment surfaces with a subsequent risk of wear, damage and slipping. The pivotal attachment of the holder arm results in play and instability, which unavoidably results in wear and other damage. Furthermore, the holder arm is mounted on one side of the mechanism, which causes unequal load distribution and, with time, results in warping of the chair and other damage.

The purpose of the invention is therefore to provide a rocker mechanism with an improved locking arrangement which will ensure positive locking with no play when applying but a low tightening force; which will avoid unequal load distribution and unfavourable loading conditions; which is self-centering and does not need to be manufactured to high precision standards nor yet particular accuracy in assembly; and which is of simple construction with regard to its function and can be manufactured at low costs.

To this end there is proposed in accordance with the invention a rocker mechanism with locking facility that has a holder and clamping plates with arcuate clamping surfaces conforming to each other and centered on the pivot axis of the rocker mechanism.

Thus, the aforesaid drawbacks encountered with the earlier known technique are overcome with a rocker mechanism constructed in accordance with the invention. Because in the locking position of the locking arrangement the clamping jaws or plates are pressed against the sides of the holder through a wedging action, positive locking with no play is achieved through the application of solely a relatively small tightening force. Furthermore, because the flank surfaces of the clamping plates have a curved shape with the centre of curvature in the pivot or rotation centre of the pivot shaft, the positions of the upper part and underpart of the rocker mechanism are guided very accurately in relation to one another in all positions of adjustment. In addition hereto, when the locking arrangement is tightened to its locking mode, the upperpart and the underpart of the rocker mechanism are held fixed relative to one another in the horizontal or lateral plane, which relieves the pivot shaft of load in the horizontal direction.

Contrary to the earlier known flat abutment surfaces of the locking devices, the top surfaces of the promontaries and the corresponding bottom surfaces of the recesses are distanced from one another in the tightened locking position. Thus, instead of a rigid abutment, between flat surfaces there is obtained a resilient locking effect, in that those parts of the clamping plates located adjacent said top and bottom surfaces function in the manner of cup springs or Belleville washers. This affords some allowance for wear with regard to the flank surfaces and also ensures that the aforesaid wedging effect will be obtained throughout the useful life of the rocker mechanism.

Because, in accordance with one preferred embodiment, the holder adjoins and projects outwardly from a surface on the upperpart or underpart of the rocker mechanism, this surface extending substantially at right angles to the rocking direction, the arm is loaded in a particularly favourable manner. With this embodiment the holder is loaded solely in the direction of its longitudinal axis and will not be subjected to lateral loads. Unequal load distribution on the rocker mechanism is avoided by locating the holder on the symmetry line of the rocker mechanism.

The invention will now be described in more detail with reference to exemplifying embodiments thereof and with reference to the accompanying drawings; in which FIG. 1 is a rocker mechanism which incorporates a locking facility according to the invention;

Figure 1:
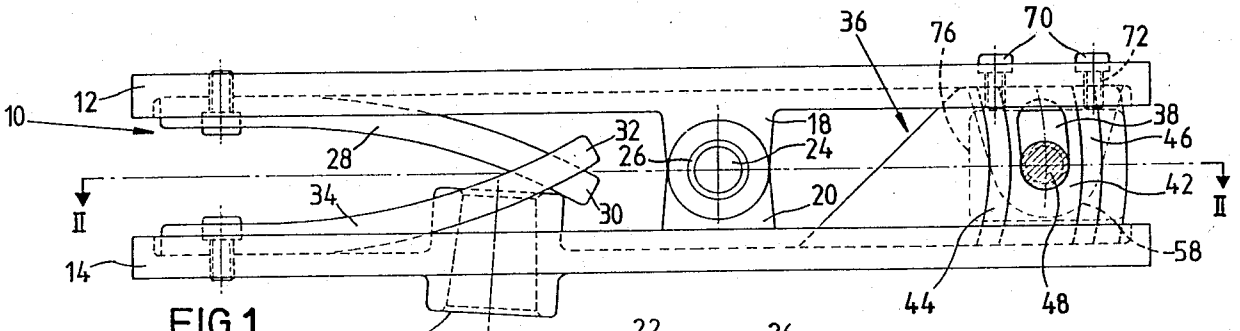
Figure 2:
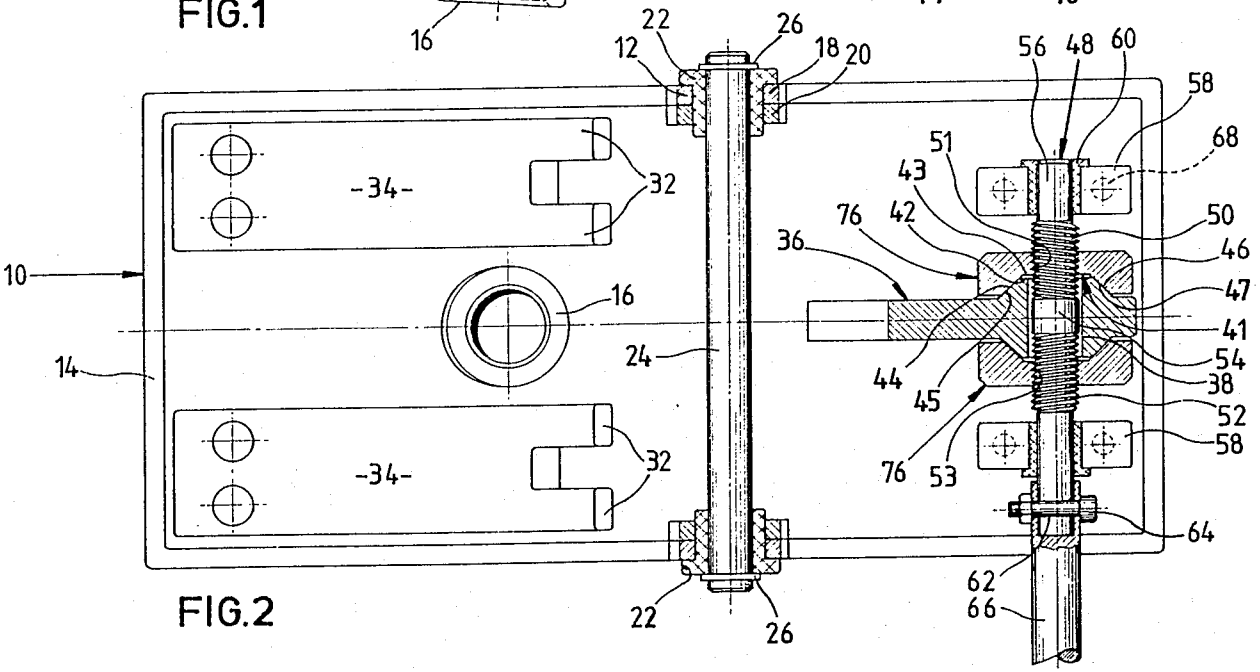
FIG. 2 is a sectional view of the rocker mechanism taken on the line II—II in FIG. 1.

FIGS. 1 and 2 are two different views illustrating a rocker mechanism and a locking facility according to the present invention. Certain components have been excluded from the Figures, for the sake of clarity. The rocker mechanism 10 comprises essentially an upperpart 12 and an underpart 14. The upper part is intended to support a seat, through the intermediary of attachment means not shown. The underpart includes a conical sleeve-journal 16 which accommodates, for example, the vertical support pin of an armchair. The upperpart and underpart present projections which incorporate respective bearing seats 18 and 20. The projections carry pairs of bearing bushes 22 which pass through the bearing seats and which in turn receive a pivot shaft 24 which is common to both bearing bushes. The shaft 24 and the bushings are held by locking rings 26 which fit into radial grooves located at respective ends of the pivot shaft.

For the purpose of facilitating and stabilizing rocking motion, the aforesaid upperpart incorporates two leaf springs 28, each of which has an outwardly projecting tongue 30 which engages between bifurcate projections 32 on two opposing leaf springs 34 on the underpart: (The tongue 30 is not shown in FIG. 2). The leaf springs are preferably pre-tensioned in a manner to bring the seat to an upper, forwardly inclined position in a load-free state.

For the purpose of locking the upper part in relation to the underpart, the underpart 14 has provided thereon an upstanding holder 36, which is formed integrally with the underpart. The holder has provided therein an elongated, slightly curved hole 38, with the centre of curvature essentially in the centre line of the pivot shaft. The holder presents two thickened parts or promontories 40 having planar top surfaces 42 and inclined flank surfaces 44, 46. The inclined flank surfaces 44, 46 are curved with the centre of curvature in the centre line of the pivot shaft. These flank surfaces 44, 46 serve as guide surfaces for two clamping jaws, which are described hereinafter.

Extending through the hole 38 is a locking rod 48 on which there is found a part which presents a lefthand screwthread 50, a part which presents a righthand screwthread 52 and an intermediate plain part 54 located therebetween. The plain part 54 of the locking rod is intended to lie in the hole 38, with the screwthreaded parts of the rod extending from the hole in a respective side thereof. The locking rod presents smooth end parts 56, by means of which the rod is journalled in bearing blocks 58 with the aid of journal bushes 60. The bearing blocks and journal bushes hold the locking rod against radial movement, but permit a given amount of movement in the axial direction. Finally, the locking rod has provided therein a diametrical throughpassing hole 62 which accommodates a bolt type fastener for fastening an auxiliary device 66, for instance a lever, a knob or a wheel, on the arresting rod. The bearing blocks 58 have provided therein screwthreaded bolt holes 68 for assembly bolts 70. The assembly bolts 70 pass through bolt holes 72 in the upperpart and hold the bearing blocks firmly to the upperpart 12.

The locking rod 48 has provided thereon two clamping jaws or plates 76 each of which has a screwthreaded hole located therein. One jaw or plate has a lefthand screwthreaded hole 51 and the other jaw a righthand screwthreaded hole 53. The sides of the clamping plates facing the holder have profiles which are complimentary relative to the thickened parts 40 of the holder. These parts thus present trapezium shaped recesses 41, having substantially planar bottom surfaces 43 and inclined flank surfaces 45 and 47. The inclined flanks have the same angle of inclination and are curved in a manner corresponding to the flanks of the holder 36, with the centre of curvature in the centre line of the pivot shaft. The clamping jaws also present planar upper surfaces 70 and lower surfaces 80.

The arrangement operates in the following manner. When assembled, the flat surfaces 78 and 80 prevent the clamping plates from rotating together with the locking rod, by striking against the upperpart 12 and the underpart 14 respectively. Consequently, when the locking rod is rotated, the clamping plates will both move either away from the holder or towards the holder. When the clamping plates are located close to the holder and the promontories 40 or enter the recesses 41, the flank surfaces 44 and 46 and the opposing flank surfaces 45 and 47 will act as guide surfaces and align the clamping plates in relation to the thickened parts 40 of the holder. The transverse dimension between opposing flanks is smaller with regard to the flat bottom surface 43 than with regard to the flat outer or top surfaces 42 of the thickened parts or promontories.

Consequently, when the locking arrangement is tightened fully, the guiding flank surfaces of the clamping plates will abut the opposing flank surfaces of the holder, such as to produce a wedging action. This provides a very positive locking action, with no play.

Because there is a certain amount of freedom for axial movement between the locking rod 48 and the bearing block 58 or the bearing bushes 60, the locking rod is able to adjust its position axially in relation to the holder 36. The whole of the locking arrangement is thus self-centering and clearance free.

An advantage is afforded when the assembly bolts 70 of the bearing blocks 58 are fitted into oversize bolt holes 72. This enables the bearing blocks to be brought into ready alignment with the holder 36. This is effected by first loosely securing the assembly bolts 70 and then tightening the clamping plates against the holder 36 with the aid of the aforesaid auxiliary device. The holder, the locking rod, and the bearing blocks are now aligned in relation to one another. The bolts 70 are then tightened against the upperpart 12, therewith securing the bearing blocks in position. This avoids the occurrence of stresses in the various components of the rocker mechanism when tightening up the locking arrangement.

The holder 36 need not necessarily have the aforedescribed form, but may have a different configuration. For example, the holder may have recesses 41 on one or both sides instead of the described thickened parts or promontories 40. The thickened parts 40 are then instead located on the clamping plates 76. The guiding flank surfaces may also have any suitable form or shape and arranged to co-act with correspondingly formed or shaped clamping plates. It is necessary, however, for the thickened parts 40 and corresponding recesses to have, at least in part, a generally trapezium configuration, since this produces an advantageous wedge effect when tightening the clamping plates.

In principle the clamping plates have an abutment surface that corresponds to the holder 36. Instead of the described screwthreaded clamping plates, there can be used divided clamping plates comprising clamping segments provided with a screwthreaded hole and abutment surfaces against the holder and externally located nut parts provided with screwthreaded holes 51 and 53 respectively. The nut parts are in flat abutment with the clamping segments. The nut parts are prevented from accompanying rotation, by flat upper and lower surfaces 78, 80 which abut the upperpart 12 and/or the upperpart 14.

According to one embodiment of the invention, the bearing blocks 58 may be formed in a manner which also enables them to serve as clamping plates or nut parts of the aforedescribed divided clamping plates. This is made possible by providing the bearing blocks with a resilient web which separates the journal part of respective bearing blocks from their attachment parts with the bolt holes 68. An advantage is afforded when the resilient web comprises a known plastics or rubber body which is firmly vulcanized to the journal part and the attachment part or secured thereto in some other way. This resilient web affords the journal parts of the bearing blocks a certain amount of mobility in the axial direction, so that they can be moved into an out of engagement with the holder 36 with the aid of the locking rod 48.

The resilient web will also function, to some extent, as a shock absorber, therewith enhancing the comfort of the seating function.

Instead of providing the bearing blocks 58 with a resilient intermediate part or web, the blocks may be mounted for movement in the axial direction of the locking rod, with the aid of elongated holes and/or some form of slide arrangement. Furthermore, a detachable holder 36 may be used instead of the illustrated holder formed integrally with the underpart of the rocker mechanism.

Figure 3:
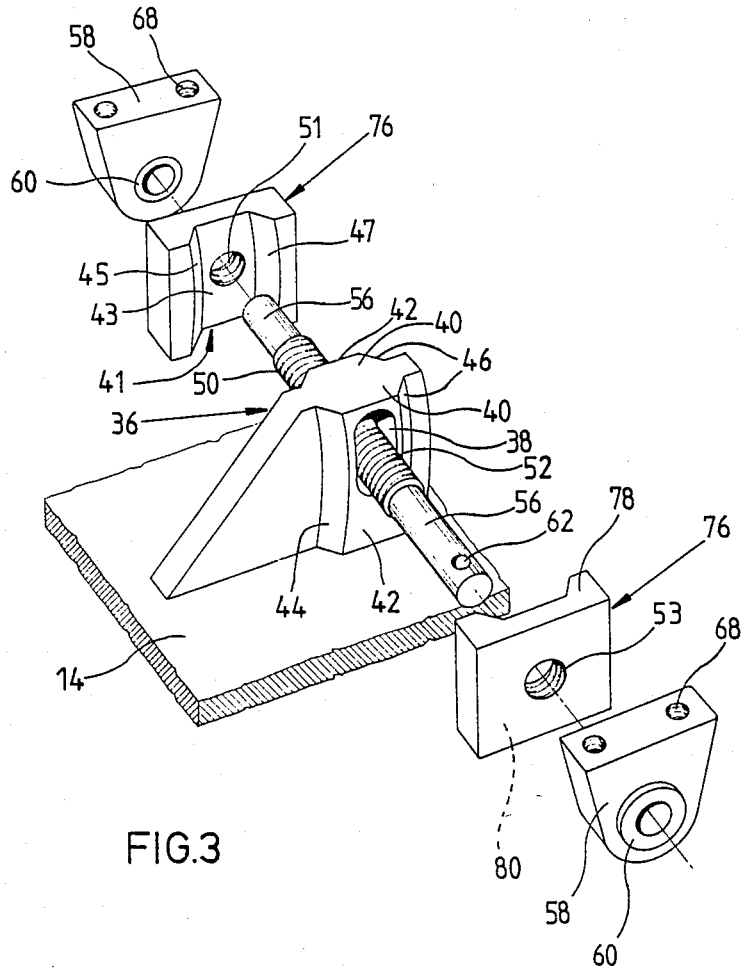
FIG. 3 is an exploded view illustrating the locking facility of the rocker mechanism.
Figure 4:
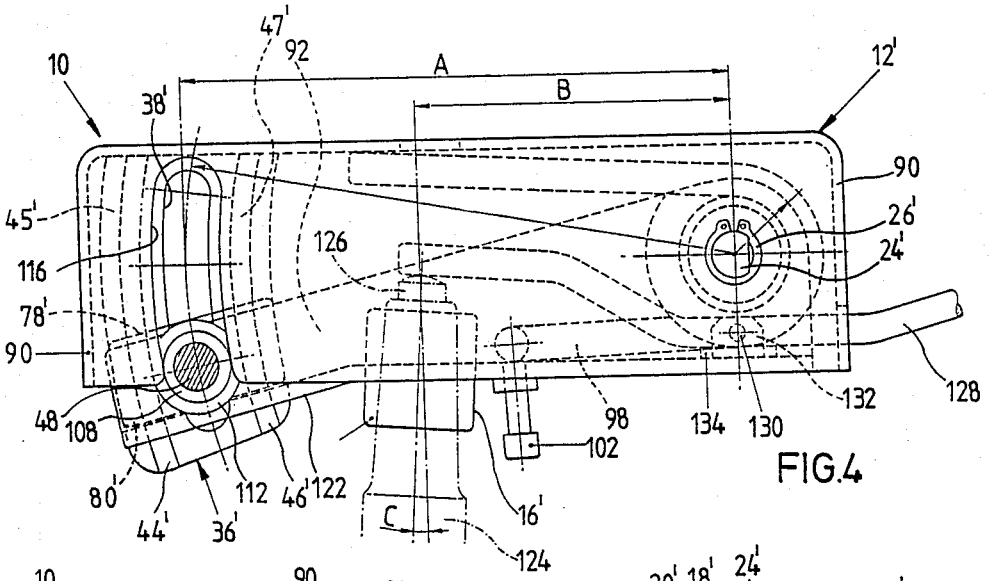
FIG. 4 is a further embodiment Of the inventive rocker mechanism.
Figure 5:
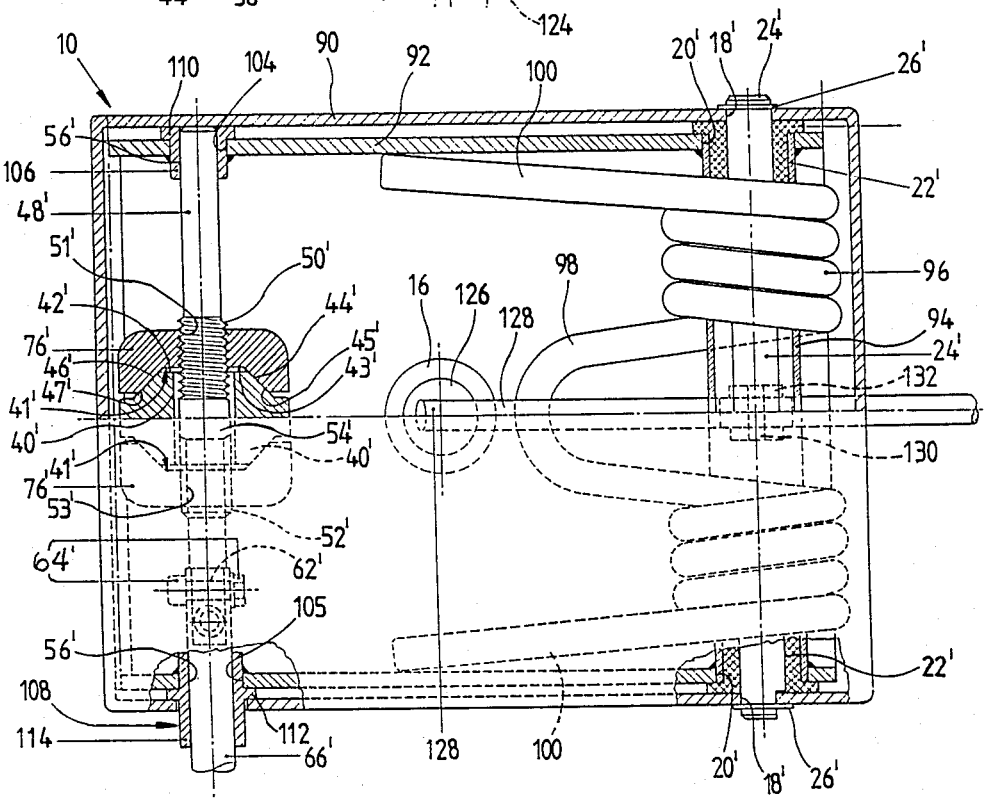
FIG. 5 is a horizontal sectional view taken on the line V—V in FIG. 4.
Figure 6:
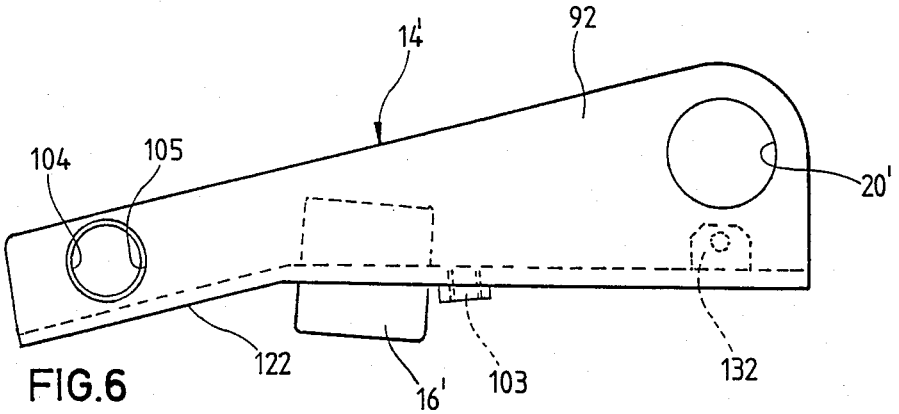
FIG. 6 is a side view of the underpart of the rocker mechanism illustrated in FIG. 4.
Figure 7:
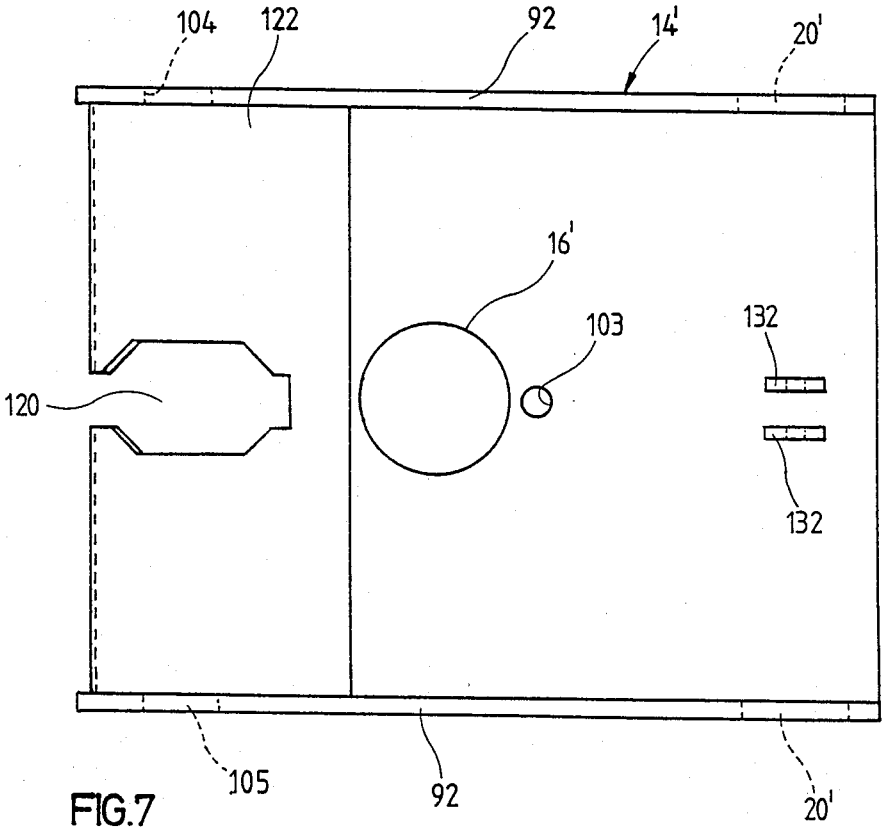
FIG. 7 is a plan view of the underpart illustrated in FIG. 6.

FIGS. 4–7 are different views of a preferred, second embodiment of a rocker mechanism according to the invention. Those components of the embodiment illustrated in FIGS. 4–7 which coincide with the components of the embodiment illustrated in FIGS. 1–3 have been identified with the same reference numerals, with the addition of a prime (′). Compared with the first embodiment, the second embodiment of the inventive rocker mechanism 10 forms a more closed structure, in that the upperpart 12′ presents a downwardly projecting side edge 90, while the underpart presents high upstanding sides 92. This reduces the amount of dust that can collect and also decreases the risk of clamping damage. The pivot shaft 24′ of the rocker mechanism is journalled in the bearing seats 18′ in the side edge 90, and carries bearing bushes 22′. The upstanding sides 92 of the underpart present bearing seats 20′ for rocker motion. There is welded to the bearing seats 20′ a tubular sleeve 94, within which the aforesaid bearing bushes 22′ are received, said tubular sleeve being shown solely in FIGS. 4 and 5. The tubular sleeve 94 supports the spring arrangement 96 of the rocker mechanism, this spring arrangement comprising two mirror-image coil-spring sections 96 having located therebetween a central loop 98 which abuts against the underpart 14′, and two side legs 100, which abut against the upperpart 12′. The force exerted by the spring arrangement can be adjusted by means of a tensioning screw 102 arranged in a hole 103 in the underpart 14′ and acting against the aforesaid centre loop.

In this embodiment of the rocker mechanism, the locking rod 48′ is not journalled in the bearing blocks 58, but in the bearing seats 104, 105 located on the upstanding sides 92 of the underpart 14′. The bearing seats 104, 105 carry bearing bushes 106, 108, which are preferably welded in position, or held against axial movement in some other way, for example with the aid of locking rings. The bearing bushes present outwardly projecting flanges 110, 112 which form spacing means against the downwardly projecting side edge 90 of the upperpart 12′. The bearing bush 108 also presents an outwardly projecting part 114, which extends through an arcuate recess 116 in the side edge 90. In the illustrated embodiment the auxiliary device 66′ is journalled in the bearing bush 108 and connected to the locking rod 48′ by means of the connecting bolt 64′. This enables the locking rod 48 to be mounted in permanently secured bearing bushes 106, 108. Alternatively, the locking rod 48′ may be journalled in detachable bearing bushes 106, 108 and present means for connecting the auxiliary operating device thereto.

The means for connecting the auxiliary operating device 66′ to the narrower connecting part of the locking rod 48′ has the form of a sleeve or corresponding element which has a suitable length and which is adapted to fit snugly around the connecting part, so as to present no clearance or play.

The holder 36′ projects down from the upperpart 12′ and is connected thereto by means of screws (not shown). The underpart 14′ has provided therein an opening or a recess 120 (FIG. 7), through which the holder 36′ can extend. The holder 36′ and the clamping plates or jaws 76′ are, in other respects, formed in essentially the same manner as those described with reference to the first embodiment. The undersurfaces 80′ of the clamping plates abut a downwardly curved part 122 on the underpart 14′. The opening 120 and the downwardly curved part 122 assist in providing a compact and space-saving rocker mechanism construction.

In this embodiment the pivot shaft 24′ and the locking arrangement are each located at a respective end of the rocker mechanism. Consequently, there is a large distance, A between the pivot shaft 24′ and the locking rod 48′, this distance being greater than the distance B between the pivot shaft 24′ and the bearing sleeve 16′ for the leg 124 carrying the rocker mechanism. There is obtained in this way a long lever arm A, which means that the locking arrangement can be tightened to its locking mode with solely a low tightening force. The aforesaid arrangement also provides a more symmetrical and less stressful attachment of the bearing sleeve 16′.

The bearing sleeve and the leg 124 may be arranged to define a given angle C with the underpart 14, 14′, thereby to afford a convenient area of inclination for a piece of furniture. The illustrated embodiment includes a leg 124 having a raising and lowering device, preferably a so-called gas spring, having an upstanding locking or operating part 126, which can be actuated by means of an auxiliary lever 128. The auxiliary lever 128 is journalled on a shaft 130 in the brackets 132. The auxiliary lever 128 abuts a resilient restoring element 134, preferably a rubber pad, at a position located beneath the journalling point 130, said restoring element being intended to move the lever 128 out of engagement with the locking or operating part 126.

In the described, preferred embodiments the opening 38, and primarily the inclined flank surfaced 44, 46 and 45, 47 respectively have a curved shape with the centre of curvature in the pivot centre of the pivot shaft 24. This is an absolute necessity for enabling the ends 56 of the locking rod 48 to be journalled in respective bearing blocks 58 in a positive clearance-free manner. The holder and the locking rod of the clamping plates or jaws may, namely, be rigidly attached in the absence of adjustment tolerances or hinged or pivoted attachment points. This also provides an inexpensive construction comprising solely a few components.

The invention is not restricted to the illustrated and described embodiments, and modifications can be made within the scope of the following claims.

I claim:

1. A rocker mechanism provided with a locking arrangement for chairs provided with rocking seats, comprising an upper part connected to the seat to pivot or rock together therewith; an underpart pivotally connected to the upper part via a pivot shaft; and rocking means for firmly locking said parts in different tilt positions relative to one another, said locking means comprising a holder connected to one of the underpart and the upper part, and which presents an opening said holder having an opening elongated in the rocking direction, and a locking rod extending through said opening and disposed parallel with the pivot shaft, said rod being rotatably journalled in the other of said underpart and upper part, said rod being provided with a lefthand and a righthand screwthread at opposite sides of said holder opening respectively, and clamping plates having corresponding screwthreads mounted for co-action with said holder, characterized in that the holder engages each clamping plate through at least one promontory and at least one recess having a shape conforming to the shape of the promontory to form respective converging and diverging flank surfaces which form guiding and locking surfaces; said converging flank surfaces of the promontories for said clamping plates, in the tightened mode of the locking arrangement abutting opposing flank surfaces of the recesses in a wedging action, said flank surfaces being curved in the rocking direction with the centre of curvature located in the pivot centre of the pivot shaft.

2. A rocker mechanism according to claim 1, characterized in that the elongated opening is curved with the centre of curvature located in the pivot centre of the pivot shaft.

3. A rocker mechanism according to claim 1, characterized in that the top surface of the promontories and the bottom surfaces of the opposing recesses are spaced from one another when said respective flank surfaces are in the tightened mode of the locking arrangement.

4. A rocker mechanism according to claim 1, characterized in that the rocker mechanism is symmetrical about a symmetry line and the holder adjoins and extends from a surface on one of the upper part and the underpart, substantially perpendicular to the rocking direction.

5. A rocker mechanism according to claim 1, characterized in that the locking rod journals are mounted by assembly bolts in oversize bolt holes to enable the clamping plates to be tightened against the holder for aligning the components prior to tightening the assembly bolts.

6. A rocker mechanism according to claim 1, characterized in that the locking rod has connecting means and a coaxial auxiliary operating device for rotating said rod.

7. A rocker mechanism according to claim 1, including an opening in said other rocker mechanism part the free end of said holder being positioned to penetrate through said opening in said different tilt position.

8. A rocker mechanism according to claim 1, wherein each of the clamping plates has a profile and abutment surface complementary to the confronting side of the holder.

9. A rocker mechanism according to claim 1, including a spring device to urge the underpart and upperpart of the mechanism away from each other in the rocking direction comprising a coil-spring arrangement having two coils, each embracing a respective end of the pivot shaft and having a free outer side leg bearing against one of the underpart and the upper part, the two coils being connected together by a centrally located loop bearing against the other of the underpart and the upper part, said other part including a tensioning screw mounted to engage the loop and displaceable to adjust the tension of said spring.

10. A rocker mechanism according to claim 1 wherein said locking rod is journalled in bearing blocks, said bearing blocks affording self-centering.

11. A rocker mechanism according to claim 1 wherein said locking rod is journalled in bearing blocks, said bearing blocks affording limited axial movement of said rod.

12. A rocker mechanism according to claim 1 wherein said underpart includes sleeve means to mount said mechanism on a chair leg having an upstanding operating part to lock said underpart to said leg, and including an operating lever with its inner end positioned adjacent said sleeve means, said lever being displaceable to engage and displace said operating part, said lever having a portion exposed beyond said underpart to afford displacement of said lever and thereby said operating part.

* * * * *

UNITED STATES PATENT AND TRADEMARK OFFICE

CERTIFICATE OF CORRECTION

PATENT NO. : 4,877,290

DATED : October 31, 1989

INVENTOR(S) : Laszlo Schetl

It is certified that error appears in the above-identified patent and that said Letters Patent is hereby corrected as shown below:

Column, 2, lines 39-40, "promon-taries" should be --promon-tories--;

Column 7, line 26, "rocking" should be --locking--;

Signed and Sealed this

Eleventh Day of September, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,877,290

DATED : October 31, 1989

INVENTOR(S) : Laszlo Schetl

It is certified that error appears in the above-identified patent and that said Letters Patent is hereby corrected as shown below:

Column 2, lines 39-40, "promon-taries" should be --promon-tories--;

Column 7, line 26, "rocking" should be --locking--;

line 30, delete "and which presents an opening".

This certificate supersedes Certificate of Correction issued September 11, 1990.

Signed and Sealed this

Second Day of October, 1990

*Attest:*

*Attesting Officer*

HARRY F. MANBECK, JR.

*Commissioner of Patents and Trademarks*